United States Patent [19]

Nishizako et al.

[11] 4,450,328

[45] May 22, 1984

[54] ELECTROMAGNETIC CONTACTOR MEANS WITH IMPROVED ARC RUNNER

[75] Inventors: Shizutaka Nishizako; Hiroaki Tazawa, both of Aichi, Japan

[73] Assignee: Mitsubishi Denki Kabushiki Kaisha, Tokyo, Japan

[21] Appl. No.: 301,866

[22] Filed: Sep. 14, 1981

[30] Foreign Application Priority Data

Sep. 19, 1980 [JP] Japan ..... 55-133200[U]

[51] Int. Cl.[3] ..... H01H 33/10

[52] U.S. Cl. ..... 200/144 R; 200/147 R

[58] Field of Search ..... 200/144 R, 147 R

[56] References Cited

U.S. PATENT DOCUMENTS 2,407,710 9/1946 Logan ..... 200/144 R
2,524,287 10/1950 Ellis ..... 200/144 R
2,654,815 9/1953 Laverty ..... 200/144 R
2,898,427 8/1959 Nadeau ..... 200/144 R

*Primary Examiner*—Robert S. Macon
*Attorney, Agent, or Firm*—Sughrue, Mion, Zinn, Macpeak & Seas

[57] ABSTRACT

An electromagnetic contact having a fixed and a moveable contact which are brought into and out of disengagement by operation of an electromagnet. An arc runner substantially surrounding the contacts aide in extinguishing the arc created upon separation of the contacts. The overhanging plate of the arc runner has stoppers which engage the side plates thereby preventing the overhanging plate from bending inward and decreasing the effectiveness of the arc runner. The arc runner is also provided with lead parts to separate the arc and purge holes for passing the hot gasses generated.

8 Claims, 6 Drawing Figures

ELECTROMAGNETIC CONTACTOR MEANS WITH IMPROVED ARC RUNNER

BACKGROUND OF THE INVENTION

The present invention relates to an improvement in an electromagnetic contactor means of the type having an arc runner for extinguishing an arc.

In general, an electromagnetic contactor means of the type to which the invention is directed is used for starting and stopping three-phase induction motors and the like. Such electromagnetic contactor means are provided with arc extinguishing means for extinguishing the arc created upon disengagement of the contacts. The repeated starting and stopping of electric motors particularly creates problems, as will be described hereafter. As the range of uses of such electromagnetic control means increases, e.g., to drive any automatic power-saving means and the like, there is a need for improvements in the arc extinguishing capabilities.

A conventional electromagnetic contactor means with a conventional arc runner is shown in FIGS. 1 through 4. In these drawings, reference numeral 1 denotes a mounting table made of an insulating material such as plastic or the like. Mounting table 1 is provided with a plurality of mounting holes 1*a* which are used to properly adjust the position of the electromagnetic contactor means. Reference numeral 2 denotes a base which is made of an insulating material. This base 2 is fixed by means of the mounting table 1 and a screw 3. Reference numeral 4 denotes a fixed iron core of laminated silicon steel plates. An operational coil 5 is mounted to the fixed iron core 4. In addition, there is interposed a flat spring 6 as a buffer material in the gap between it and the mounting table 1. Reference numeral 7 denotes a movable iron core which is arranged in such a way as to be opposite to the fixed iron core 4. If an electric current is passed through the operational coil 5, the moveable core 7 is pulled in such a way as to come in contact with the fixed iron core 4. Reference numeral 8 denotes a cross bar which is attached to the moveable iron core 7 via a pin 9. Reference numeral 10 denotes an unfastening spring which is disposed between the cross bar 8 and the mounting table 1. Usually, the unfastening spring 10 pushes the cross bar 8 so as to keep open the main circuit of the electromagnetic contactor means. Reference numeral 11 denotes a moveable contactor which is provided with a contact 11*a*. This moveable contact 11 is inserted into a retaining hole 8*a* which is formed in the cross bar 8, and a pressure is applied thereto by means of a pressure spring 12. Reference numeral 13 denotes a fixed contactor which is provided with a contact 13*a* opposite to the contact 11*a* of the moveable contactor 11. This fixed contactor 13 is fixed to the base 2 by means of a screw 14 and is provided with a terminal screw 15 to be connected to the electric wire of the main circuit. Reference numeral 16 denotes a cover made of an insulating material. This cover 16 is fixed to the base 2 by means of a screw 17.

Reference numeral 18 denotes an arc runner made of magnetic metal material which is formed in such a way as to surround the contact portion 11*a* of the moveable contactor 11 as well as the contact portion 13*a* of the fixed contactor 13. As shown in detail in FIG. 4, this arc runner 18 is bent in such a way as to have a cross-section of ]-shape. This arc runner is composed of a driving part 18*a* for driving the arc as well as an overhanging plate part 18*b* which covers the upper portion of the driving part 18*a*.

Now, the opening and closing operation of this electromagnetic contactor means will be explained. When a voltage is applied to the operational coil 5, a magnetic flux is produced in the gap between the fixed iron core 4 and the moveable iron core 7, and the moveable iron core 7 is pulled towards the fixed iron core 4 so as to be in contact therewith against the spring force of the unfastening spring 10. At this time, the cross bar 8 which is attached to the moveable iron core 7 is also actuated in the same way. The contact 11*a* of the moveable contactor 11 comes into contact with the contact 13*a* of the fixed contactor 13 and, at the same time, a predetermined pressure is applied thereto by means of the pressure spring 12 so as to close the main circuit.

In order to disconnect the main circuit, the operational coil 5 is demagnetized. The moveable iron core 7 moves away from the fixed iron core 4 due to the energizing force of the unfastening spring 10. The cross bar 8 also moves in association with the movement of moveable iron core 7. Therefore, cross bar 8 is returned to the position as shown in FIG. 2 and at the same time, contact 13*a* of the fixed contactor 13 disengages from the contact 11*a* of the moveable contactor 11.

During the disengaging of the contacts, an arc is generated at the portion indicated by (a) in FIG. 2 in the gap between the contact 11*a* and the contact 13*a*. This arc is driven by the driving part 18*a* of the arc runner 18 and moves to the position indicated by (b). Furthermore, as indicated by (c), this arc moves to the gap between the overhanging plate part 18*b* of the arc runner 18 and the movable contactor 11 and is extinguished.

A hot gas is generated along with the generation of the arc, and it flows out by way of the retaining hole 8*a* of the cross bar 8. As a result, the elasticity of the pressure spring 12 which is arranged in the retaining hole 8*a* is deteriorated, thereby resulting in a fused bonding between the contacts 11*a* and 13*a*. In addition, if the opening and closing operation of the electromagnetic contactor means is repeated frequently, a lot of hot gas is generated and the temperature of the arc runner, in particular, the overhanging plate 18*b* which is directly exposed to the arc, becomes abnormally high due to the insufficiency of the heat capacity of the arc runner 18. As a result, part 18*b* becomes curved and approaches the moveable contactor 11. As a consequence, further arcs are generated in the vicinity of the approaching part of 18*b*, thereby fusing and spoiling the moveable contactor 11. Furthermore, since the arc is not sufficiently long under the latter condition, the cooling effect is lowered and the shielding ability is reduced.

SUMMARY OF THE INVENTION

In accordance with the present invention, the deficiencies mentioned above are overcome by providing the overhanging plate part of the arc runner with a stopper part which engages the driving part. As a result, the overhanging plate part will not bend toward the inner side of the arc runner.

In accordance with the present invention as mentioned above, since there is provided a stopper which engages the driving part of the overhanging plate of the arc runner, the overhanging plate part is prevented from being bent toward the inside of the arc runner.

BRIEF DESCRIPTION OF THE DRAWINGS

in these drawings, the same reference numerals denote the same or corresponding parts.

DETAILED DESCRIPTION OF THE PREFERRED EMBODIMENT

Figure 1:
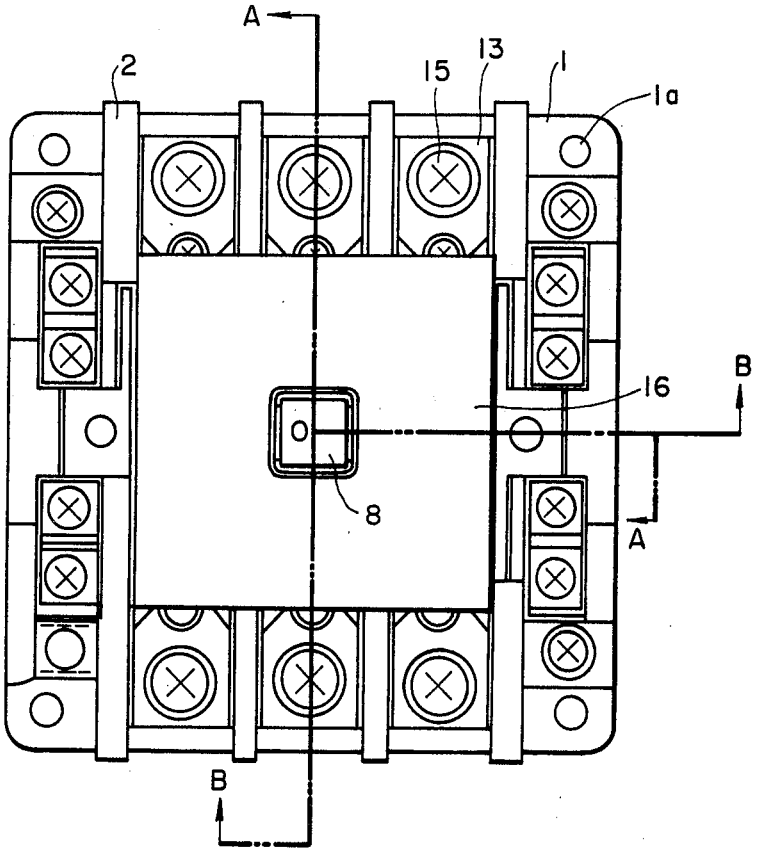
FIG. 1 is a plan view showing a conventional electromagnetic contactor means.
Figure 2:
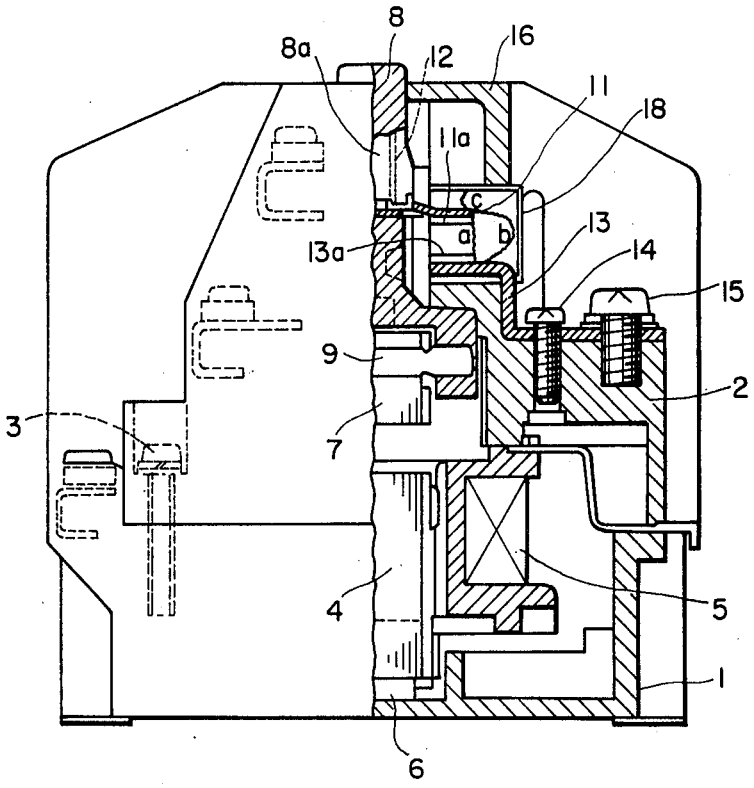
FIG. 2 is a partial cross-sectional view taken along line A-O-A in FIG. 1.
Figure 3:
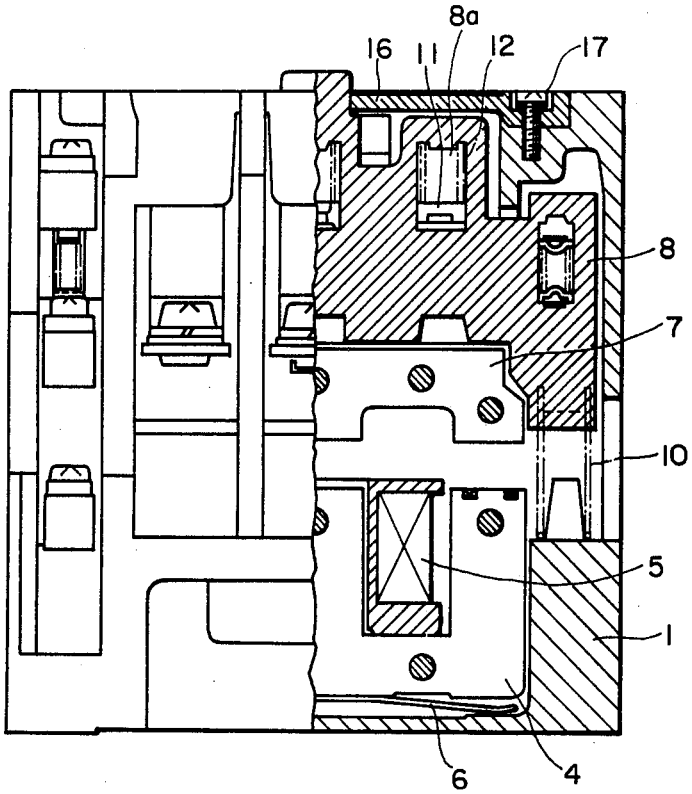
FIG. 3 is a partial cross-sectional view taken along line B-O-B in FIG. 1.
Figure 4:
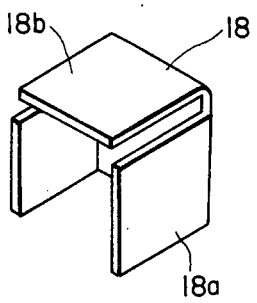
FIG. 4 is a perspective view of a prior art arc runner.

One embodiment in accordance with the present invention will be explained below with reference to FIG. 5 and FIG. 6. In these drawings, the same reference numerals as those in FIGS. 1–4 denote the same or corresponding parts, of which the explanation will be omitted accordingly.

Figure 5A:
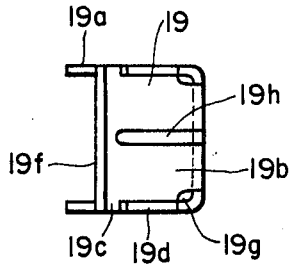
FIG. 5 is a view showing an arc runner of one embodiment in accordance with the present invention, (*a*) is a plan view thereof, (*b*) is a side view thereof, (*c*) is a front view thereof.
Figure 5B:
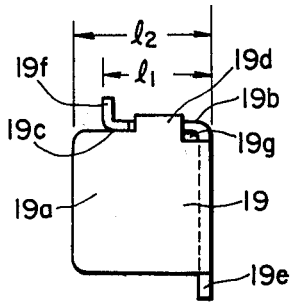
Figure 5C:
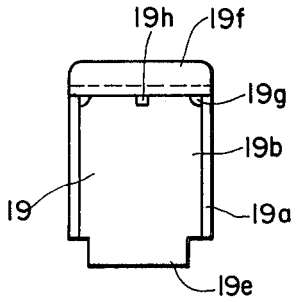

FIG. 5 shows an arc runner made of magnetic metal material and composed of a driving part 19*a* which is bent so as to have a cross-section of ]-shape and an overhanging plate part 19*b* which covers the upper part of this driving part 19*a*. The overhanging plate part 19*b* is provided with a stopper part 19*c* which engages the driving part 19*a*. The driving part 19*a* is provided with a pair of clasping parts 19*d* for clasping the overhanging plate part 19*b*.

In addition, the driving part 19*a* is provided with the first arc lead part 19*e* on the other side of the overhanging plate part 19*b*. The overhanging plate part 19*b* is provided with the second arc lead part 19*f* of which the end is bent outwards. In this case, the length $l_1$ of the overhanging plate part 19*b* is set shorter than the length $l_2$ of the driving part 19*a* (Ref. FIG. 5(*b*)). A gas purging hole 19*g* is formed at the corner part when the driving part 19*a* and the overhanging plate part 19*b* are bent. A gas purging hole 19*h* which is long in the direction that the arc is driven is formed in the overhanging plate part 19*b*.

Figure 6:
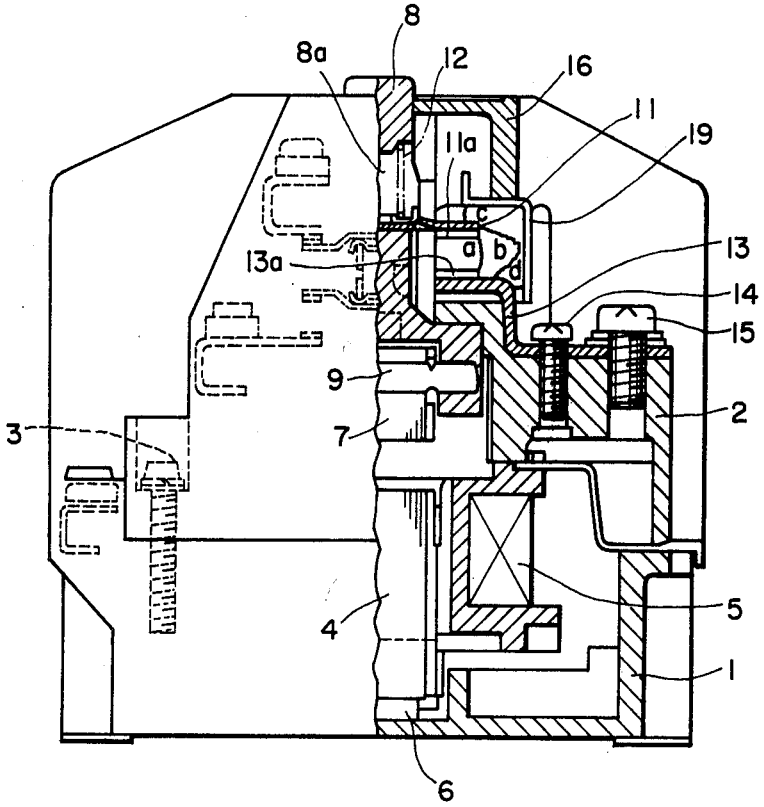
FIG. 6 is a partial cross-section side view of an electromagnetic contactor means with an arc runner which is shown in FIG. 5.

FIG. 6 is a partial cross-sectional view of the electromagnetic contactor means with the arc runner 19. This electromagnetic contactor means is actuated so as to open and close in the same way as in the conventional means. When the contacts 11*a* and 13*a* are detached from each other, a hot gas is generated together with the arc.

Now, the actuation to extinguish the arc will be explained.

In FIG. 6, the arc which is generated at the position indicated by (a) is moved to the position indicated by (b) in the same way as in what is called "extinguishing system" by dia-ion-grid, that is, the magnetic flux due to the arc current passes through the driving plate 19*a* so as to apply driving power to the arc. Since the arc runner 19 is provided with a first arc lead part 19*e* and the second arc lead part 19*f*, the arc is moved in a separate manner to the positions indicated by (d) and (c), that is, between the fixed contactor 13 and the first arc lead part 19*e* and between the moveable contactor 11 and the second arc lead part 19*f*, so as to be extinguished. Since the hot gas which is generated together with the arc is also separated along with the arc in the conditions indicated by (d) and (c) and released from the upper part and the lower part of the arc runner 19, the arc extinguishing time is relatively short and the shielding capacity is improved.

The opening and closing operation of the electromagnetic contactor means is repeated frequently, and a lot of hot gas is generated. Even if the temperature of the overhanging plate 19*b* becomes abnormally high, the overhanging plate 19*b* is prevented from curving towards the inside of the driving part 19*a* because the stopper 19*c* engages the driving part 19*a* so as to work as a stopper. In addition, since the driving part 19*a* is provided with the clasping part 19*d* for clasping the overhanging plate 19*b*, bending in the opposite direction is also prevented.

Furthermore, since the hot gas in the arc runner 19 is dispersed and released from the gas purging holes 19*g* at the corners or the gas purging hole 19*h* of the overhanging plate 19*b*, the pressure in the arc runner decreases more rapidly, and the cooling effect of the arc is accordingly promoted. In addition, since the length $l_1$ of the overhanging plate 19*b* is shorter than the length $l_2$ of the driving part 19*a*, a hot gas releasing part is formed between the overhanging plate 19*b* and the cross bar 8. Therefore, the hot gas is not jetted directly into the retaining hole 8*a* of the cross bar 8. It now becomes possible to prevent the pressure spring 12, which is arranged in the retaining hole 8*a*, or the retaining hole 8*a* itself from being deteriorated by the hot gasses.

What is claimed is:

1. In an electromagnetic contactor of the type having first and second contacts which engage and disengage in response to electromagnetic controls and which create an arc between said contacts upon disengaging, and an arc runner having a driving part comprising a back plate facing said contacts and side plates on opposite sides of said contacts and having an overhanging plate above said contacts, the improvement comprising:

stopper means on said overhanging plate adapted to engage said side plates for preventing said overhanging plate from bending toward the inside of said arc runner, said overhanging plate and back plate having first and second arc lead parts, respectively, said first arc lead part of said overhanging plate being disposed at an end thereof above said contact and being bent outwards above an intermediate portion of said side plate.

2. An electromagnetic contactor as claimed in claim 1 wherein said driving part is provided with a clasping part for clasping said overhanging plate.

3. An electromagnetic contactor as claimed in claim 1 wherein said arc runner is provided with a plurality of holes for purging gas.

4. An electromagnetic contactor as claimed in claim 3 wherein said gas purging holes are provided at corners of said arc runner where said back plate meets said overhanging plate.

5. An electromagnetic contactor as claimed in claim 4 wherein said gas purging holes further include a hole formed in said overhanging plate, said latter gas purging hole being elongated in the driving direction of said arc.

6. An electromagnetic contactor as claimed in claim 1 wherein a length of said overhanging plate is shorter than that of said side plates.

7. An electromagnetic contactor as claimed in claim 1, wherein said arc runner causes two arcs to be formed upon separation of said first and second contacts, a first of said two arcs being driven by side plates so as to extend between said first and second contacts and said second contact and said first arc lead part of said overhanging plate, said second of said two arcs being driven so as to extend between said first contact and said back plate.

8. An electromagnetic contactor as claimed in claim 1, wherein said arc runner comprises an integral part which forms a continuous magnetic circuit in response to creation of said arc.

* * * * *